US005746520A

United States Patent [19]

Kohira

[11] Patent Number: 5,746,520

[45] Date of Patent: May 5, 1998

[54] PRINTER WITH PRINTHEAD AND PRESSING BODY IN POINT CONTACT

[75] Inventor: Hiroyuki Kohira, Chiba, Japan

[73] Assignee: Seiko Instruments Inc., Japan

[21] Appl. No.: 676,134

[22] PCT Filed: Nov. 8, 1995

[86] PCT No.: PCT/JP95/02277

§ 371 Date: Aug. 1, 1996

§ 102(e) Date: Aug. 1, 1996

[87] PCT Pub. No.: WO96/14213

PCT Pub. Date: May 17, 1996

[30] Foreign Application Priority Data

Nov. 8, 1994 [JP] Japan ..... 6-273259

[51] Int. Cl.[6] ..... B41J 2/32

[52] U.S. Cl. ..... 400/120.01; 400/120.16; 347/197; 347/222

[58] Field of Search ..... 400/120.01, 120.17, 400/120.16, 120.05, 120.06; 347/197, 198, 222, 180, 182, 220, 181

[56] References Cited

U.S. PATENT DOCUMENTS

| | | | |
|---|---|---|---|
| 4,235,555 | 11/1980 | Aprato | 400/120.16 |
| 4,844,632 | 7/1989 | Minowa | 400/120.17 |
| 5,071,266 | 12/1991 | Harada et al. | 400/120.17 |
| 5,156,467 | 10/1992 | Kithara et al. | 400/120.17 |
| 5,181,787 | 1/1993 | Hosomi | 400/120.16 |

FOREIGN PATENT DOCUMENTS

| | | | |
|---|---|---|---|
| 345079 | 12/1989 | European Pat. Off. | 347/198 |
| 2185448 | 7/1990 | Japan | 347/198 |

*Primary Examiner*—Edgar S. Burr
*Assistant Examiner*—Leslie Grohusky
*Attorney, Agent, or Firm*—Adams & Wilks

[57] ABSTRACT

A printer comprises a frame having a pair of side walls spaced apart a given distance according to a given width size of a recording medium. A platen is supported between the pair of side walls and has a surface for supporting the recording medium. A printhead, operable in a printing position thereof to perform a printing operation on the recording medium, is supported between the side walls for tilting movement and displacement in forward/backward and rightward/leftward directions. A pressing body is supported by the frame for pressing the printhead into contact with the surface of the platen. When the printhead is in the printing position, the printhead is freely pivotable to permit automatic angular adjustment thereof following the surface of the platen so that the printhead can contact the surface of the platen with a uniform surface pressure.

29 Claims, 9 Drawing Sheets

PRINTER WITH PRINTHEAD AND PRESSING BODY IN POINT CONTACT

FIELD OF THE INVENTION

The present invention relates to a printer with a platen and a printhead. More particularly, the present invention relates to a printer having a structure for supporting a printhead.

BACKGROUND ART

FIG. 7 shows an example of a conventional printer. The printer includes a platen 101 which is rotatably provided to bridge along the width direction of a recording medium (not shown). The printer also has a printhead 102 which is disposed at the back of the platen 101. Further, the printer includes a pressing body 103 to press a front surface of the printhead 102 from the rear thereof into contact with the platen 101. The pressing body 103 has a vertical shaft 104 and a horizontal shaft 105. A torsion spring 106 is wound on the horizontal shaft 105 to generate a pressing force. The vertical shaft 104 pierces the printhead 102 to rotatably support the printhead 102.

FIGS. 8A and 8B show another example of a conventional printer. FIG. 8A represents a printhead 201 and FIG. 8(B) represents a frame 202. As shown in the figure, the frame 202 has left and right side walls 203 and 204 which are disposed facing each other at a distance depending on the width of a recording medium (not shown). The printhead 201 is incorporated between the left and right side walls 203 and 204. In this example, protrusions 205 and 206 are formed at both ends of the lower portion of the printhead 201, respectively. Through holes 207 and 208 are formed in the protrusions 205 and 206, respectively. On the other side, in the lower portions of the left and right side walls 203 and 204, through holes 209 and 210 are formed, respectively. In a state where the printhead 201 is incorporated in the frame 202, the above-mentioned through holes 207, 208, 209, and 210 are aligned. By inserting a shaft (not shown) in the through holes, the printhead 201 can be provided to bridge rotatably with respect to the frame 202.

FIGS. 9A and 9B show still another example of a conventional printer. A pair of upper and lower pins 302 and 303 are formed at the left end in the width direction of the printhead 301. In the same manner, a pair of upper and lower pins 304 and 305 are formed at the right end in the width direction of the printhead 301. On the other hand, the frame 306 has left and right side walls 307 and 308 which are disposed facing each other at a distance depending on the width of a recording medium (not shown). A guide slit 309 is formed in the left side wall 307. The guide slit 309 branches into a vertical branch portion 310 and an arc-like branch portion 311. In the same manner, a guide slit 312 is formed in the right side wall 308. The guide slit 312 branches into a vertical branch portion 313 and an arc-like branch portion 314. The above-mentioned printhead 301 is incorporated in the frame 306 dropwise from above. In an assembled state, the upper pin 302 is engaged with the arc-like branch portion 311 while the lower pin 303 is engaged with the vertical branch portion 310. In the same manner, the upper pin 304 is engaged with the arc-like branch portion 314 while the lower pin 305 is engaged with the vertical branch portion 313. In this state, the printhead 301 rotates backward and forward with the lower pins 303 and 305 being the center of the rotation. Here, the upper pins 302 and 304 are guided by the arc-like branch portions 311 and 314, respectively.

In the conventional printer shown in FIG. 7, the printhead 102 is axially supported by the vertical shaft 104 of the pressing body 103 so that the printhead 102 can tilt right and left. Therefore, when the front surface of the printhead 102 is pressed from the rear thereof into contact with the platen 101 by the action of the torsion spring 106, the printhead 102 can tilt and move right and left to absorb the deviation. However, since the horizontal shaft 105 connected with the vertical shaft 104 is fixedly supported with respect to the frame, the printhead 102 cannot move backward and forward directions when pressed into contact with the platen 101. Since the extent of the tilt of the printhead 102 in the directions backward and forward can not be adjusted, it is difficult to completely absorb the dimensional error and the installation error of the platen 101.

In the conventional printer shown in FIGS. 8A and 8B, the through holes 207, 208, 209, and 210 must be aligned after the printhead 201 is incorporated in the frame 202. The positioning is time-consuming and, therefore, the fabrication is inferior. In addition, since the printhead 201 and the frame 202 are coupled to each other by a horizontal shaft (not shown), the printhead 201 rotates only backward and forward. As the printhead 201 can not tilt and move right and left, the deviation with the platen (not shown) can not be absorbed. Still further, since the tilted position in the directions of backward and forward is regulated, the dimensional error and the installation error of the platen can not be absorbed.

In the conventional printer shown in FIGS. 9A and 9B, the printhead 301 can be incorporated in the frame 306 dropwise from the above, and thus fabrication is facilitated as compared with the conventional printer shown in FIGS. 8A and 8B. However, this printer has a problem that, since the guide slits 309 and 312 having branches are formed in the left and right side walls 307 and 308, the strength of the frame is lowered.

SUMMARY OF THE INVENTION

An object of the present invention is to provide a printer having a structure in which a printhead is pressed uniformly in contact with a platen. Another object of the present invention is to provide a printer with excellent incorporativity of a printhead and excellent strength of a frame.

A printer according to the present invention comprises a frame, a platen, a printhead, and a pressing body as a basic structure. The frame has left and right side walls which are provided facing each other at a distance depending on the width of a recording medium. The platen is rotatably provided to bridge between the two side walls. The printhead is also provided between the two side walls, and is disposed at the back of the platen. The pressing body is incorporated in the frame to press a front surface of the printhead from the rear thereof into contact with the platen By this construction, the printhead can tilt and displace in forward/backward and rightward/leftward directions according to the position of the platen, and the pressing body is in point contact with the printhead. With such a structure, during a printing operation, the printhead can be pressed into contact with the platen so that it follows the rotation of the platen.

Specifically, the printhead and the pressing body are formed of separate components which can be separately incorporated. One of the printhead and the pressing body has a convex spherical surface portion, and the other has a plane portion. The convex spherical surface portion and the plane portion are in point contact with each other. Alternatively, the printhead and the pressing body may have convex cylindrical surface portions which intersect each other to be made in point contact with each other. Preferably, the printhead has a wide upper portion which is made by pressing in contact with the platen and a narrow lower portion which is integral with the wide upper portion. On the other hand, the left and right side walls have thin portions to be engaged wish the wide upper portion and thick portions to be en gaged with the narrow lower portion, respectively.

According to the present invention, a printhead can tilt and move backward and forward and right and left according to the position of a platen. Further, a pressing body is in point contact with a printhead. Since the operating portion of the press is a point, a printhead can tilt and move backward and forward and right and left, and can be made by pressing uniformly in contact with a platen. By this construction, deviation can be prevented, which is effective for improving the print quality (by preventing a blur) and the linearity of advance of a recording medium. Further, since a pressing body and a printhead are independent of each other, the printhead can be incorporated or exchanged with ease. Still further, a printhead is T-shaped having a wide upper portion and a narrow lower portion integral with the wide upper portion. According to this, the side walls of a frame are divided into thin portions and thick portions. With such a structure, the strength of the frame is improved. Further, a printhead can be incorporated in the frame dropwise from above, and the dead space inside the frame can be effectively utilized. Different from the conventional printer, since there is no need to insert a horizontal shaft and the incorporation can be done from above, the fabrication is improved. Since through holes through which a horizontal shaft is inserted are not necessary, the structure of a die for forming a printhead can be simplified (sliding is unnecessary) to lower the cost.

DETAILED DESCRIPTION OF THE PREFERRED EMBODIMENTS

Figure 1A:
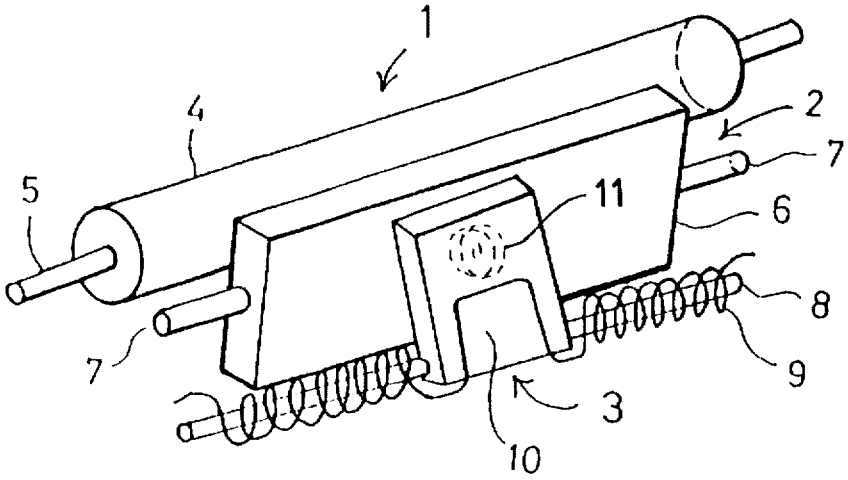
FIGS. 1A–1C are schematic drawings showing basic structures of a printer according to the present invention.

Preferred embodiments of the present invention will now be described in detail in the following with reference to the drawings. FIG. 1 shows basic structures of a printer according to the present invention, and three different aspects are denoted as (A), (B), and (C). A printer shown in FIG. 1(A) includes a frame (not shown), a platen 1, a printhead 2, and a pressing body 3 as a basic structure. The frame has left and right side walls which are disposed facing each other at a distance depending on the width of a recording medium (not shown). The platen 1 is rotatably provided to bridge between the two side walls. Specifically, the platen 1 comprises a cylindrical elastic body 4 made of rubber or the like and a rotating shaft 5 which pierces the center of the elastic body 4. Both ends of the rotating shaft 5 are supported by the left and right side walls of the frame. The printhead 2 is also provided to bridge between the two side walls of the frame, and is disposed at the back of the platen 1. Specifically, the printhead 2 comprises a head-supporting body 6 on which a thermal element (not shown) is mounted and a pair of support members or pins 7 located at both ends of the head-supporting body 6. The head-supporting body 6 and the pins 7 can be integrally formed using a material such as aluminum. The pressing body 3 is incorporated in the frame to press a front surface of the printhead 2 into contact with the platen 1 from a rear surface thereof. Specifically, the pressing body 3 has a horizontal shaft 8, a torsion spring 9 wound on the horizontal shaft 8, and a plane member 10 attached in the middle of the horizontal shaft 8. The torsion spring 9 generates pressing force to press forward the printhead 2 via the plane member 10. By this construction, the thermal element, etc. provided on the printhead 2 is placed in contact with the platen 1.

As characteristic matters of the present invention, the printhead 2 is flexibly engaged with the two side walls of the frame via the pins 7 at its both ends, and can tilt and move backward and forward and right and left according to the position of the platen 1. On the other hand, the pressing body 3 is in point contact with the printhead 2. With such a structure, during a printing operation, the printhead 2 can be pressed uniformly into contact with the cylindrical body 4 following up the rotation of the platen 1. It should be noted that the printhead 2 and the pressing body 3 are formed of separate components which can be separately incorporated. In the present embodiment, while the pressing body 3 has a plane member 10, at the back of the head-supporting body 6, a convex spherical surface portion 11 is formed. The structure is such that the plane member 10 and the convex spherical surface portion 11 are in point contact with each other.

Figure 1B:
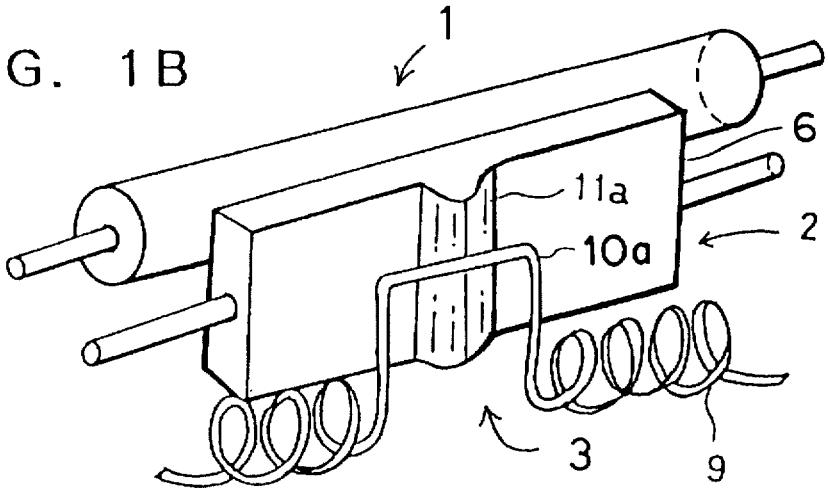

The printer shown in FIG. 1(B) has basically the same structure. Like reference numerals designate corresponding parts to those in the printer shown in FIG. 1(A) so as to be understood easily. In the present embodiment, the head-supporting body 6 has in the middle of its rear surface a vertical convex cylindrical surface portion 11*a*. On the other hand, the pressing body 3 comprises a torsion spring 9 shown by a thick line. The middle portion 10*a* of the torsion spring 9 extends in the horizontal direction and has a convex cylindrical surface portion. The vertical convex cylindrical surface portion 11*a* formed on the rear surface of the head-supporting body 6 and the convex cylindrical surface portion formed on the horizontal middle portion 10*a* on the side of the pressing body 3 intersect each other to be kept in point contact with each other.

Figure 1C:
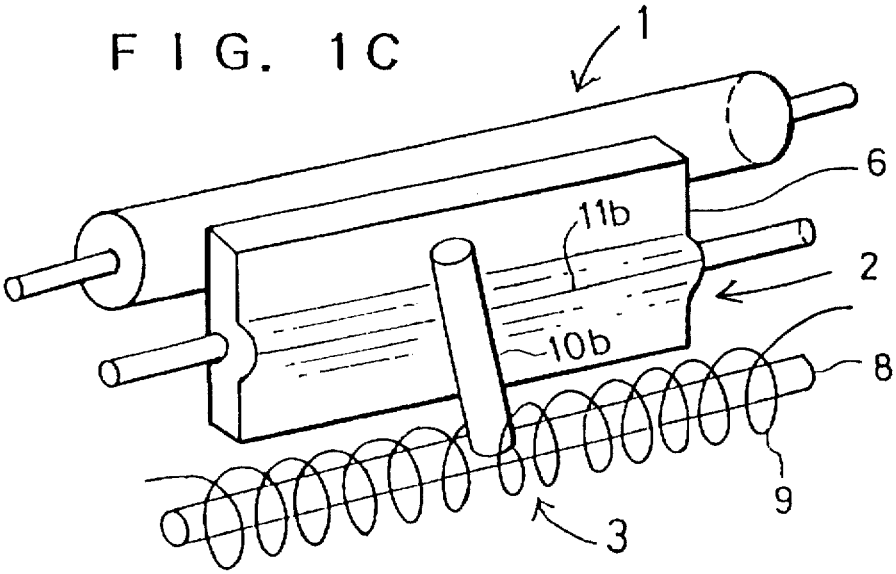

The printer shown in FIG. 1(C) also has basically the same structure. Like reference numerals designate corresponding parts to those in the printer shown in FIG. 1 (A) so as to be understood easily. At the rear surface of the head-supporting body 6, a convex cylindrical surface portion 11*b* which extends in the horizontal direction is formed. On the other hand, the pressing body 3 has a vertical post 10*b* substantially in the middle of the horizontal shaft 8. The vertical convex cylindrical surface of the post 10*b* and the horizontal cylindrical surface portion 11*b* on the side of the head-supporting body 6 intersect each other to form point contact between the bodies.

Figure 2A:
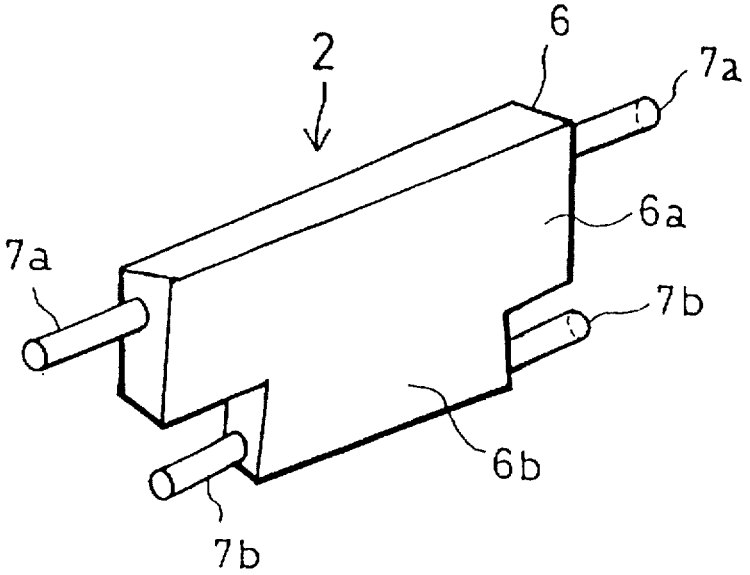
FIGS. 2A–2B are also schematic drawings showing a basic structure of a printer according to the present invention.
Figure 2B:
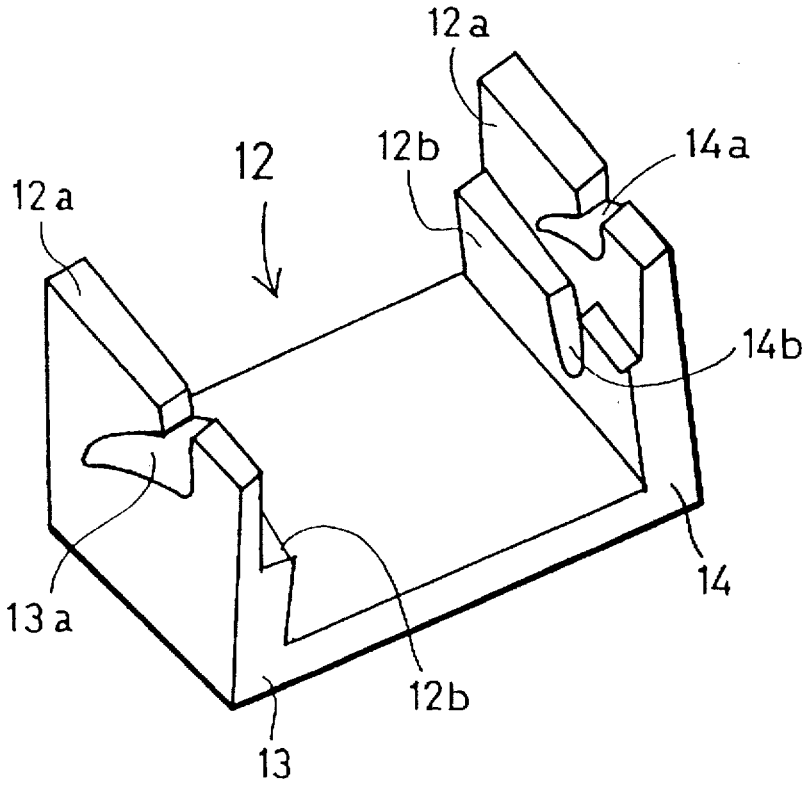

FIGS. 2A and 2B show another example of a structure of a printer according to the present invention. FIG. 2(A) shows the printhead 2 and FIG. 2(B) shows a frame 12. The printhead 2 has the head-supporting body 6. A pair of upper and lower pins 7*a* and 7*b* are formed at the right end of the head-supporting body 6. In the same manner, a pair of upper and lower pins 7*a* and 7*b* are also formed at the left end of the head-supporting body 6. The head-supporting body 6 and the pins 7*a* and 7*b* can be integrally formed using a material such as aluminum. Different from a conventional printer, there is no need to provide through holes through which a horizontal shaft is inserted, and thus, the structure of a die for forming the head-supporting body 6 can be simplified (sliding is unnecessary) to lower the cost. As shown in the figure, the head-supporting body 6 has a wide upper portion 6*a* which is made by pressing in contact with the platen (not shown) and a narrow lower portion 6*b*. Therefore, the head-supporting body 6 according to the present embodiment is substantially T-shaped in the plan view.

On the other hand, the frame 12 has left and right side walls 13 and 14 which are provided facing each other at a distance depending on the width of a recording medium (not shown). The right side wall 14 has a thin portion 12*a* to be engaged with the wide upper portion 6*a* of the head-supporting body 6 and a thick portion 12*b* to be engaged with the narrow lower portion 6*b* of the head-supporting body 6. A substantially arc-like guide slit 14*a* is formed in the thin portion 12*a* while a vertical guide slit 14*b* is formed in the thick portion 12*b*. In the same manner, the left side wall 13 is divided into the thin portion 12*a* and the thick portion 12*b*. The thin portion 12*a* has a substantially arc-like guide slit 13*a* while the thick portion 12*b* has a vertical guide slit.

The distance between the two thin portions 12*a* which face each other across the width direction is set so as to exactly fit the width of the wide upper portion 6*a* of the head-supporting body 6. In the same manner, the distance between the two thick portions 12*b* which face each other across the width is set so as to fit the width of the narrow lower portion 6*b* of the head-supporting body 6. Thus, it is possible to provide a step between the thin portion 12*a* and the thick portion 12*b* or the side of the frame 12 according to the difference in size of the wide upper portion 6*a* and the narrow lower portion 6*b* on the side of the head-supporting body 6. With such a structure, the mechanical strength of the pair of left and right side walls 13 and 14 can be improved. Since the thick portion 12*b* is provided utilizing the dead space inside the frame 12, the width of the frame does not increase compared to a conventional one. The frame 12 having such a structure can be formed by injection molding of resin or the like.

The printhead 2 is incorporated in the frame 12 dropwise from the above. By this, the printhead 2 is provided to bridge between the left and right side walls 13 and 14 of the frame 12. Looking at the right side wall 14, the upper pin 7*a* of the printhead 2 is engaged with the arc-like guide slit 14*a* while the lower pin 7*b* is engaged with the vertical guide slit 14*b*. With respect to the left side wall 13, the same thing can be said. With such a structure, the printhead 2, while bridging across the frame 12, rotates backward and forward with the lower pin 7*b* being the center of the rotation. It should be noted that a predetermined clearance is left between the pin 7*b* and the vertical guide slit 14*b* so that the printhead 2 can move backward and forward a little. When the printhead 2 rotates backward and forward, the upper pin 7*a* moves along the arc-like guide slit 14*a*. Even when the printhead 2 rotates forward and touches the platen (not shown), the pin 7*a* does not touch the deepest portion of the guide slit 14*a* so that the printhead 2 can tilt right and left. It should be noted that the guide slit 14*a* precisely aligns the printhead 2 with respect to the vertical direction. With such a structure, the printhead 2 can tilt and displace in forward/backward and rightward/leftward directions according to the position of the platen. On the other hand, as described above, the pressing body (not shown) is in point contact with the printhead 2. Thus, during a printing operation, the printhead 2 can be pressed uniformly into contact with the cylindrical surface of the platen so that it follows the rotation of the platen. In other words, the dimension error and the installation error of the platen can be absorbed, and the deviation and the like can be effectively prevented.

Figure 3B:
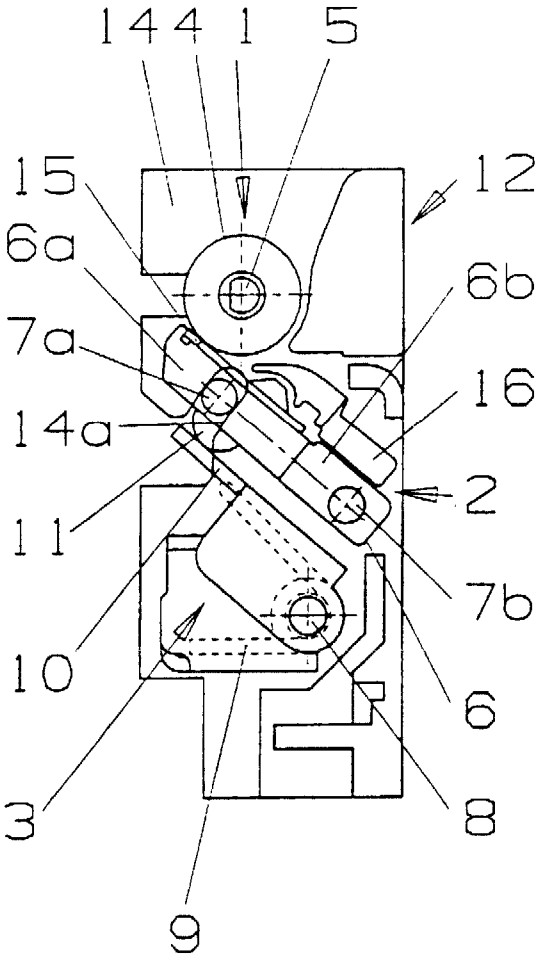
FIGS. 3A and 3B are a plan view and a right elevational view, respectively, showing a specific structure of a printer according to the present invention.
Figure 3A:
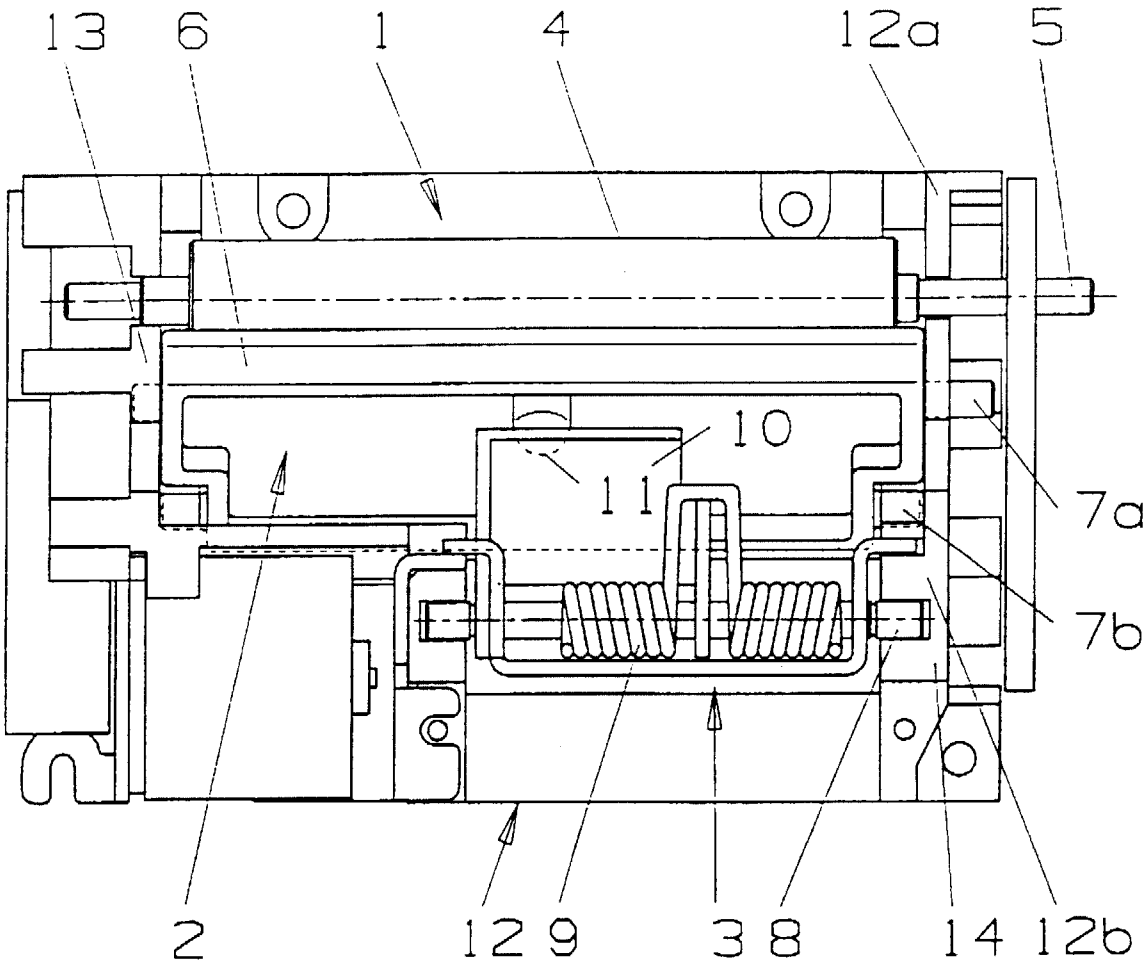

FIG. 3A is a plan view and FIG. 3B is a right elevational view showing an example of a specific structure of a printer according to the present invention. This printer is basically embodied by the combination of the structure of the pressing body shown in FIG. 1(A) and the structures of the printhead and the frame shown in FIGS. 2A and 2B. Therefore, like reference numerals designate corresponding parts so as to be understood easily. As shown in the figure, this printer is fabricated using the frame 12. The frame 12 has left and right side walls 13 and 14 which are at a distance depending on the width of a recording medium. The platen 1 is rotatably provided to bridge between the two side walls 13 and 14. As described above, the platen 1 has the cylindrical elastic body 4 made of rubber or the like and a rotating shaft 5. The rotating shaft 5 is supported by the left and right side walls 13 and 14, and is driven to rotate via a motor and a series of gears (not shown). By this construction, a recording medium is fed. The printhead 2 is also provided to bridge between the two side walls 13 and 14, and is disposed at the back of the platen 1. As described above, the printhead 2 has the head-supporting body 6 to the front face of which a board 15 is attached. On the board 15, a thermal element and a driving circuit are mounted. Further, a pressing member 16 of a flexible connector to be connected with the board 15 is also attached to the front face of the head-supporting body 6. On the other hand, the convex spherical surface portion 11 is formed at the back of the head-supporting body 6. As described above, the head-supporting body 6 is divided into the wide upper portion 6*a* and the narrow lower portion 6*b*. The pin 7*a* formed in the wide upper portion 6*a* is engaged with the arc-like guide slit 14*a* formed in the thin portion 12*a* of the side wall 14. The pin 7*b* formed in the narrow lower portion 6*b* of the head-supporting body 6 is engaged with the vertical guide slit formed in the thick portion 12*b* of the side wall 14.

The pressing body 3 has the horizontal shaft 8, by which the pressing body 3 is incorporated in the frame 12. The torsion spring 9 which generates a predetermined pressing force is wound on the horizontal shaft 8. The plane member 10 is attached to the horizontal shaft 8. The plane member 10 is in point contact with the convex spherical surface portion 11 of the head-supporting body 6 described above. By this construction, the pressing body 3 presses a front surface of the printhead 2 from the rear thereof into contact with the platen 1. The right elevational view in FIG. 3B shows the state of the contact by pressing. The thermal element mounted on the front face of the head-supporting body 6 is in close contact with the cylindrical elastic body 4 of the platen 1 and performs a predetermined print operation to a recording medium disposed therebetween. Here, the upper pin 7*a* of the printhead 2 can move in the arc-like guide slit 14*a*, and thus, the printhead 2 can tilt right and left to absorb a deviation with the platen 1. Further, the lower pin 7*b* of the head-supporting body 6 is engaged wit the side wall 14 with a little clearance being left, and thus the head-supporting body 6 can tilt and move backward and forward. Thus the fine control of the tilted position of the printhead 2 with respect to the platen 1 is possible. In other words, the positioning of the printhead 2 is regulated by the upper pin 7*a* only in the vertical direction, and the incorporation is such that the printhead 2 can move right and left and backward and forward with respect to the frame 12.

Figure 4A:
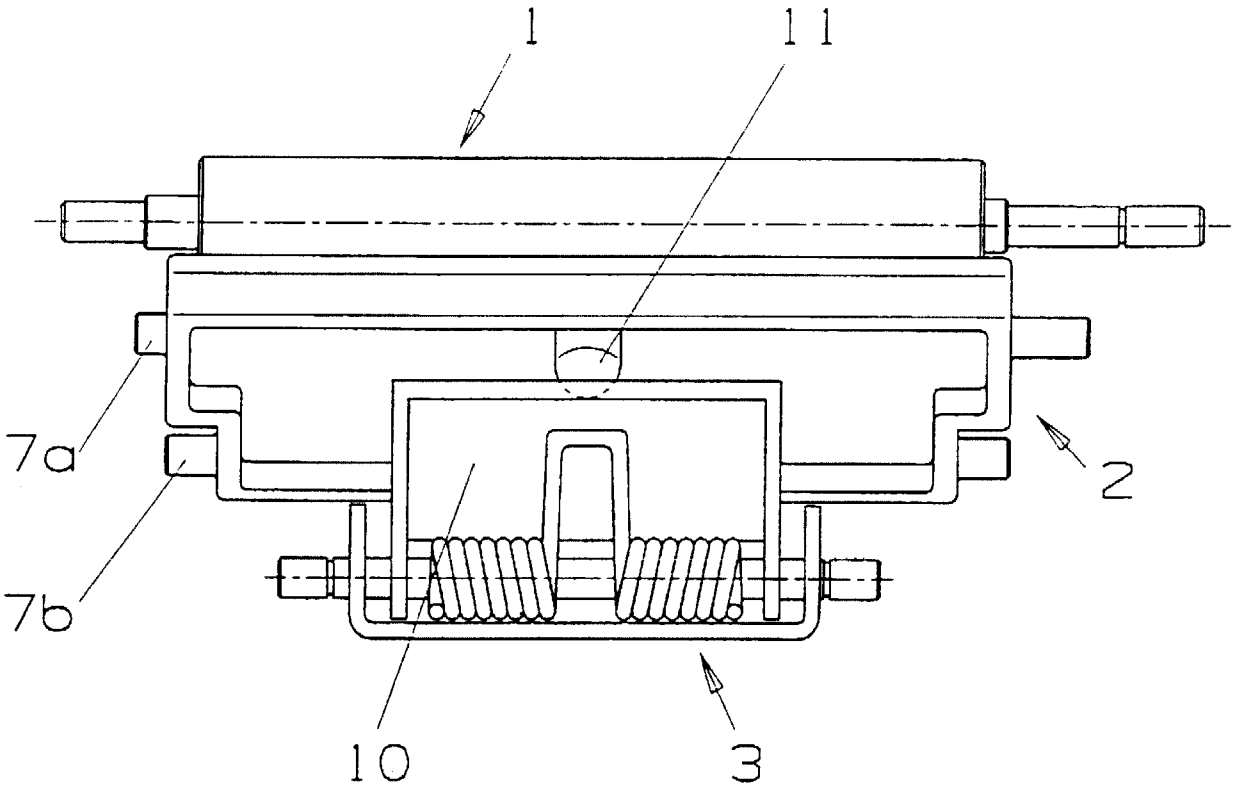
FIGS. 4A and 4B are a plan view and an elevational view, respectively, showing the main portion of the printer shown in FIG. 3.
Figure 4B:
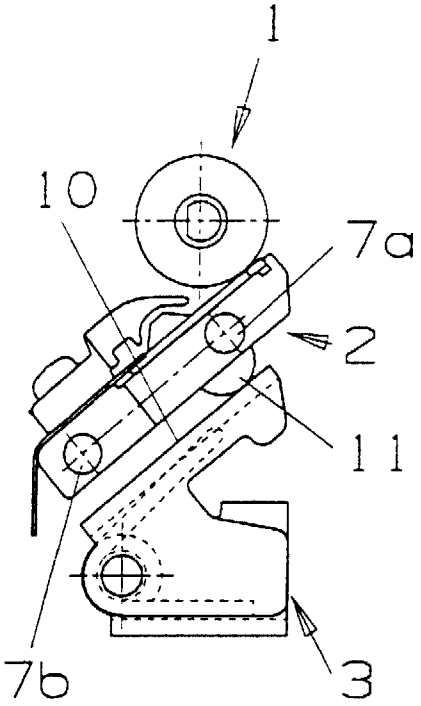

FIGS. 4A and 4B show only the main components of the printer shown in FIGS. 3A–3B to clarify the relation of the arrangement. As shown in the figure, the pressing body 3 presses the printhead 2 into contact with the platen 1. The printhead 2 is attached to the frame by a pair of upper and lower pins 7*a* and 7*b* so as to move backward and forward and right and left. The convex spherical surface portion 11 of the printhead 2 is in point contact with the plane portion 10 of the pressing body 3. With such a structure, the printhead 2 is pressed into contact with the platen 1 following up the platen 1 in backward and forward and right and left direction.

Figure 5A:
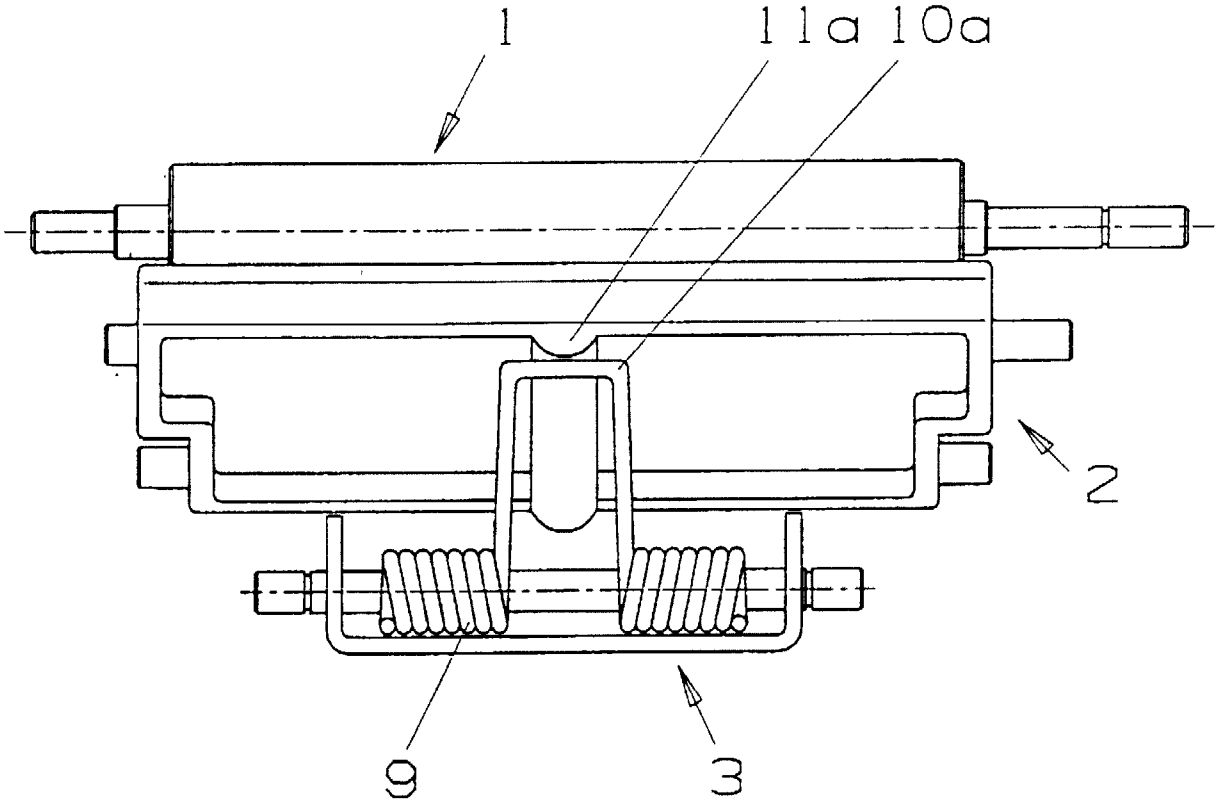
FIGS. 5A and 5B are a plan view and an elevational view, respectively, showing an example of a variation of the structure shown in FIG. 4.
Figure 5B:
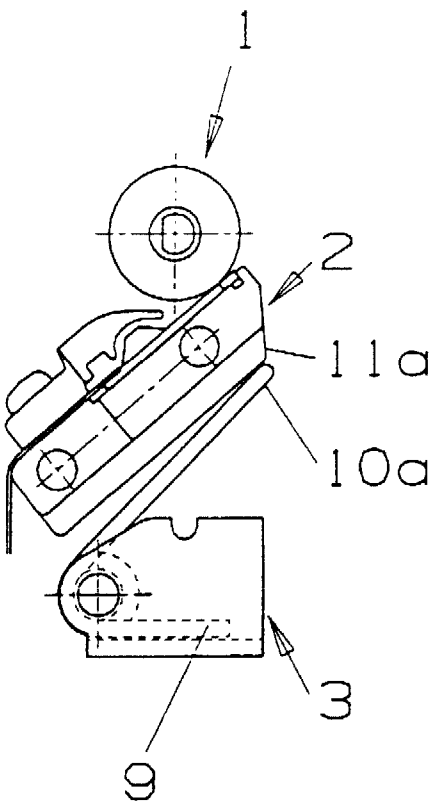

FIGS. 5A and 5B show an example of a variation of the structure shown in FIGS. 4A and 4B. Like reference numerals designate corresponding parts so as to be understood easily. It should be noted that this variation corresponds to the structure shown in FIG. 1(B). The convex cylindrical surface portion 11*a* which extends in the vertical direction is formed at the back of the printhead 2. On the other hand, the middle portion 10*a* of the torsion spring 9 incorporated in the pressing body 3 extends in the horizontal direction. The cylindrical surface portion of the middle portion 10*a* is orthogonal to and is in point contact with the cylindrical surface portion 11*a* on the side of the printhead 2.

Figure 6A:
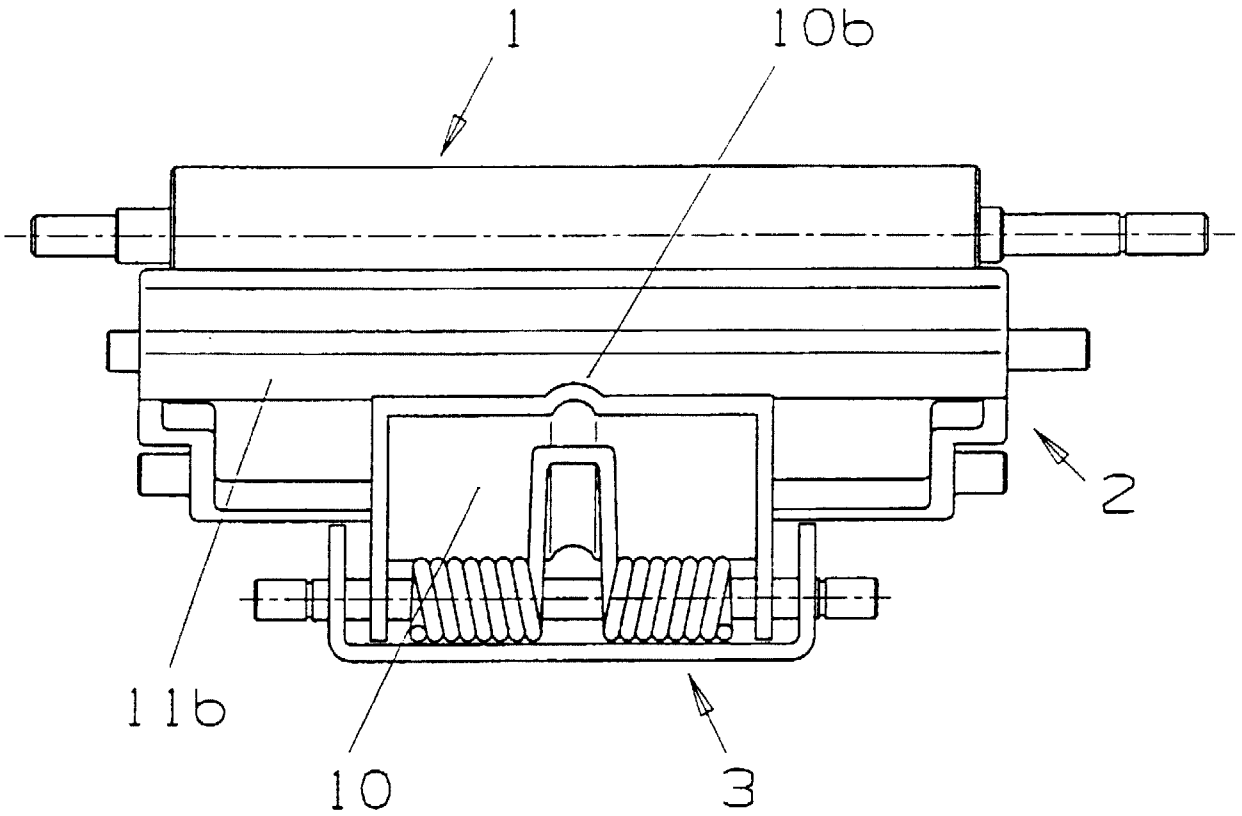
FIGS. 6A and 6B are also a plan view and an elevational view, respectively, showing another example of a variation of the structure shown in FIG. 4.
Figure 6B:
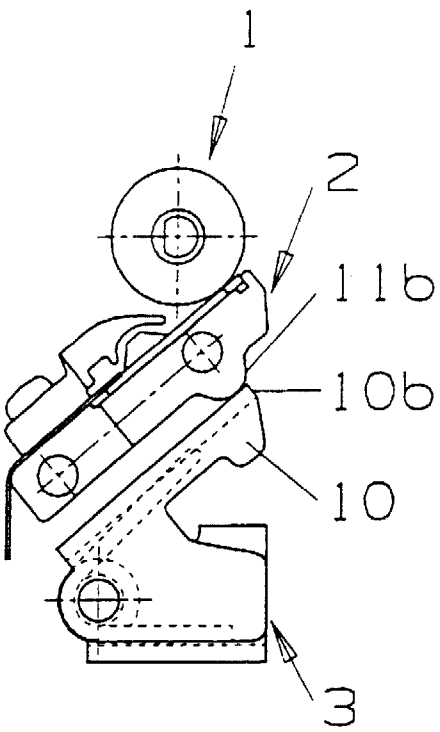
Figure 7:
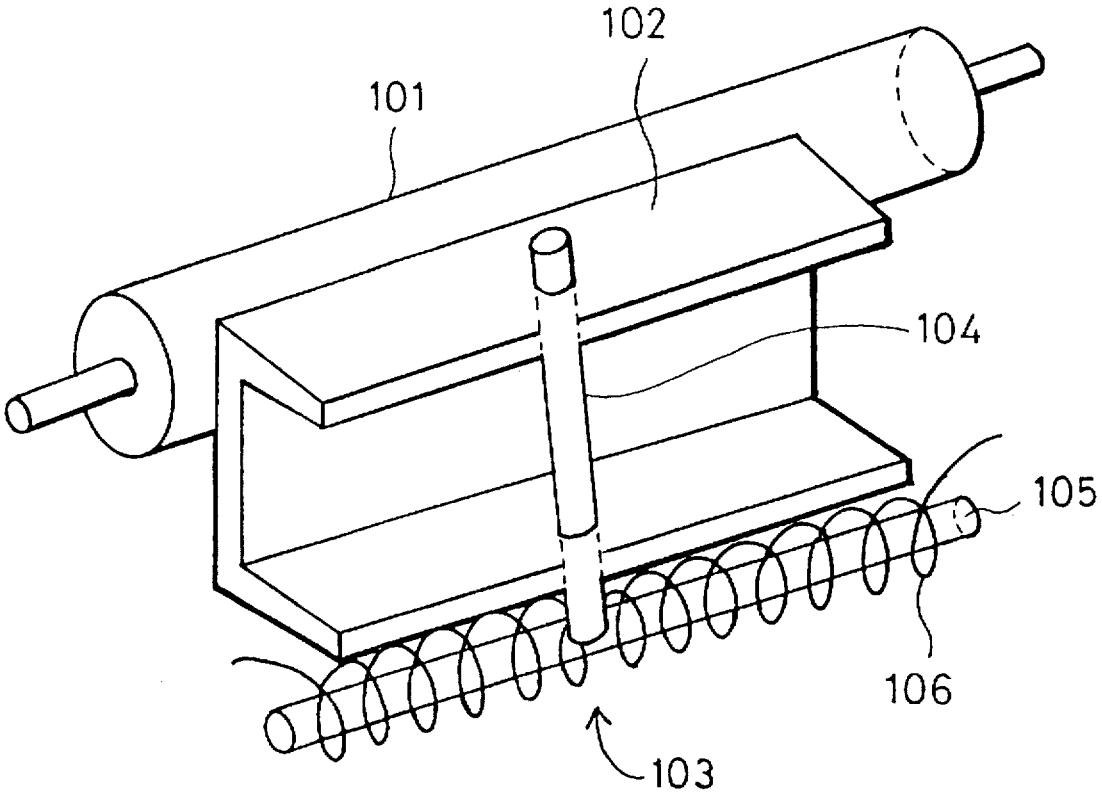
FIG. 7 PRIOR ART
FIG. 7 is a schematic drawing showing an example of a conventional printer.
Figure 8A:
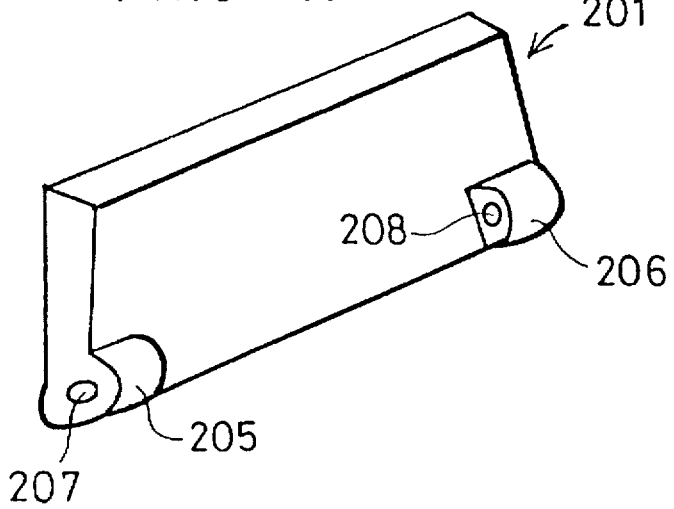
FIG. 8A PRIOR ART
FIGS. 8A–8B are schematic drawings showing another example of a conventional printer.
Figure 8B:
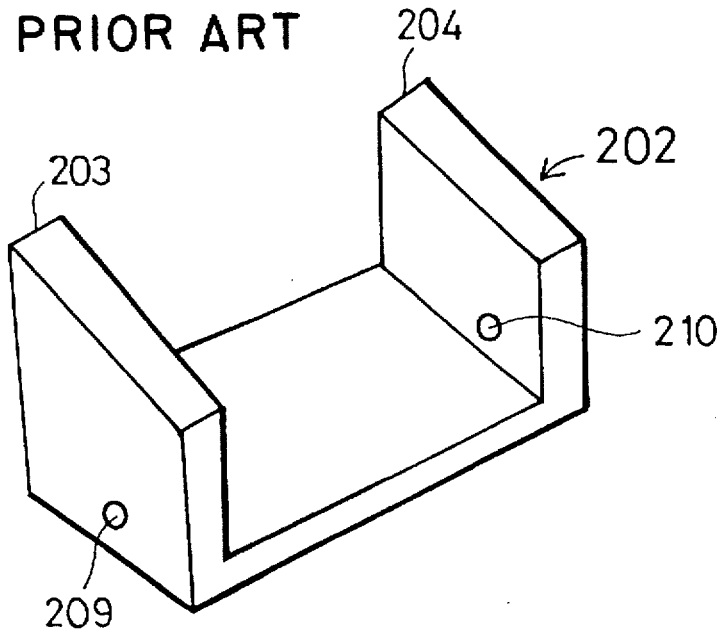
FIG. 8B PRIOR ART
Figure 9A:
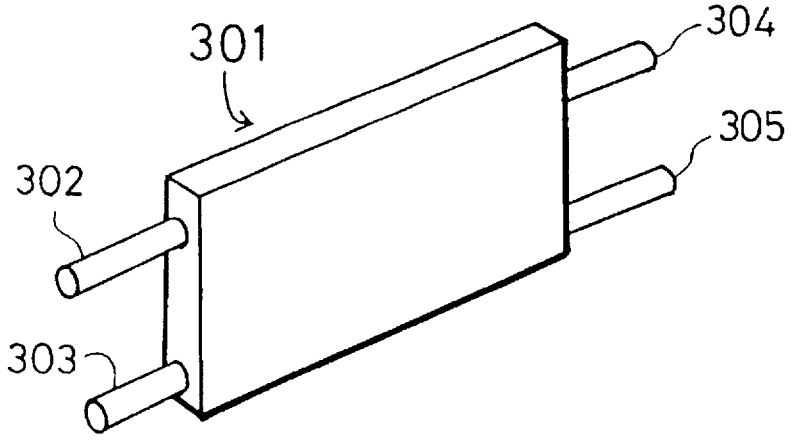
FIG. 9A PRIOR ART
FIGS. 9A–9B are schematic drawings showing still another example of a conventional printer.
Figure 9B:
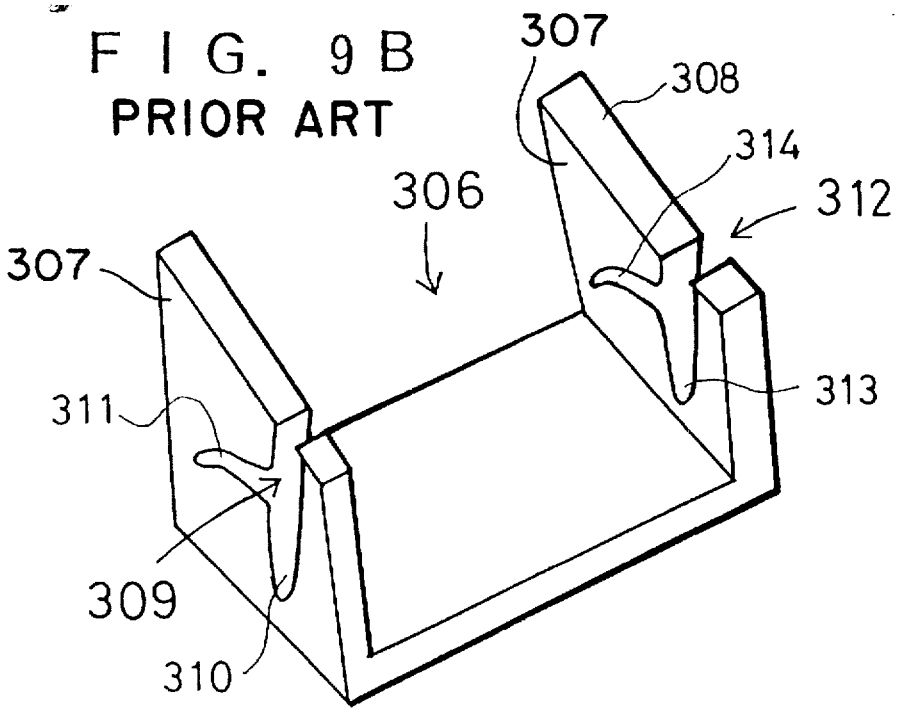
FIG. 9B PRIOR ART

FIGS. 6A and 6B show another variation of the structure shown in FIGS. 4A and 4B. Like reference numerals designate corresponding parts so as to be understood easily. In the present example, the convex cylindrical surface portion 11*b* in the horizontal direction is formed at the back of the printhead 2. On the other hand, the vertical convex cylindrical surface portion 10*b* is formed in the middle of the plane member 10 of the pressing body 3. The convex cylindrical surface portions 10*b* and 11*b* which are orthogonal to each other are in point contact with each other to enable the printhead 2 to tilt and move backward and forward and right and left.

Industrial Utilization

According to the present invention, since the operating portion of the press is a point, a printhead can tilt and move backward and forward and right and left, and can be pressed uniformly into contact with a platen. Therefore, it is effective for improving the print quality and the linearity of advance of a recording medium. Further, since a pressing body and a printhead are independent of each other, a printhead can be removed (exchanged) with ease. Still further, by making a printhead to be T-shaped, the dead space in a frame is effectively utilized, and at the same time, fabrication by dropping a printhead from the above is made possible. Together with this, a thin portion and a thick portion are provided in a side wall of a frame so as to improve the strength of the frame.

I claim:

1. A printer comprising: a frame having side walls spaced apart a given distance according to a given width size of a recording medium; a platen rotatably supported between the side walls; a printhead disposed between the side walls and behind the platen, the printhead extending substantially from one side wall to the other side wall the printhead being operable in a printing position thereof to perform a printing operation on the recording medium; means supporting the printhead to the side walls of the frame for movement of the printhead in forward/backward and rightward/leftward directions relative to the frame; and a pressing body supported by the frame for pressing a rear surface portion of the printhead in point contact therewith to bring a front surface of the printhead into contact with a contacting surface of the platen; whereby the printhead can move in forward/backward and rightward/leftward directions relative to the frame following the contacting surface of the platen upon movement of the printhead to the printing position.

2. A printer according to claim 1; wherein the printhead and the pressing body are formed of independent components which can be independently incorporated into the printer.

3. A printer according to claim 1; wherein one of the printhead and the pressing body has a convex spherical surface portion and the other of the printhead and the pressing body has a plane portion, the convex spherical surface portion and the plane surface portion being in point contact with each other when the printhead is in the printing position.

4. A printer according to claim 1; wherein the printhead and the pressing body have convex cylindrical surface portions which intersect each other and are in point contact with each other when the printhead is in the printing position.

5. A printer according to claim 1; wherein the printhead has a wide upper portion and a narrow lower portion integral with the wide upper portion, the wide upper portion having the front surface of the printhead which is pressed into contact with the contacting portion of the platen when the printhead is in the printing position; and wherein the side walls have thin portions for engagement with the wide upper portion of the printhead and thick portions for engagement with the narrow lower portion of the printhead.

6. A printer according to claim 1; wherein the pressing body comprises a biasing member.

7. A printer according to claim 6; wherein the biasing member comprises a torsion spring having a horizontal portion centrally thereof for pressing the rear surface portion of the printhead in point contact therewith.

8. A printer according to claim 6; wherein the biasing member comprises a shaft rotatably supported by the frame, a plane portion integrally connected to the shaft centrally thereof, and a torsion spring for pressing the plane portion into point contact with the rear surface portion of the printhead.

9. A printer according to claim 6; wherein the biasing member comprises a first shaft rotatably supported by the frame, a second shaft integrally connected to the first shaft centrally thereof, and a torsion spring for pressing the second shaft into point contact with the rear surface portion of printhead.

10. A printer according to claim 9; wherein each of the rear surface portion of the printhead and the second shaft of the biasing member has a convex cylindrical surface in point contact with each other when the printhead is in the printing position.

11. A printer according to claim 1; wherein the printhead comprises a support body; and wherein the means supporting the printhead comprises a pair of pins extending from the support body each for engagement with one of the side walls of the frame.

12. A printer according to claim 1; wherein the printhead comprises a support body having a first portion and a second portion integral with the first portion; and wherein the means supporting the printhead comprises a first pair of pins extending from the first portion each for engagement with one of the side walls of the frame, and a second pair of pins extending from the second portion each for engagement with one of the side walls of the frame.

13. A printer comprising: a frame having left and right side walls spaced apart a given distance according to a given width size of a recording medium, the side walls having first portions having a first preselected thickness and second portions having a second preselected thickness greater than the first preselected thickness; a platen rotatably supported between the side walls; a printhead rotatably supported between the side walls and disposed behind the platen, the printhead having an upper portion supported by the first portions of the side walls and a lower portion integral with the upper portion and supported by the second portions of the side walls, the upper portion having a first preselected width, the lower portion having a second preselected width smaller than the first preselected width, and the upper portion having a contact surface which is pressed into contact with the platen; and a pressing body for pressing the contact surface of the upper portion of the printhead from a rear portion thereof into contact with the platen.

14. A printer comprising: a frame having a pair of side walls spaced apart a given distance according to a given width size of a recording medium; a platen supported between the pair of side walls and having a surface for supporting the recording medium; a printhead supported between the side walls and operable in a printing position thereof to perform a printing operation on the recording medium; the printhead extending substantially from one side wall to the other side wall and support means for supporting the printhead for movement in forward/backward and rightward/leftward directions relative to the frame, following the surface of the platen, when the printhead is in the printing position.

15. A printer according to claim 14; wherein the support means comprises support members for pivotally supporting the printhead to the frame, and a pressing body for pressing a rear surface portion of the printhead in point contact therewith to bring a front surface of the printhead into contact with the surface of the platen.

16. A printer according to claim 15, wherein the printhead comprises a support body; and wherein the support members comprise a pair of pins extending from the support body each for engagement with one of the side walls of the frame.

17. A printer according to claim 15; wherein the printhead comprises a support body having a first portion and a second portion integral with the first portion; and wherein the support members comprise a first pair of pins extending from the first portion each for engagement with one of the side walls of the frame, and a second pair of pins extending from the second portion each for engagement with one of the side walls of the frame.

18. A printer according to claim 15; wherein one of the printhead and the pressing body has a convex spherical surface portion and the other of the printhead and the pressing body has a plane surface portion in point contact with the convex spherical surface portion.

19. A printer according to claim 15; wherein each of the printhead and the pressing body has a convex cylindrical surface portion in point contact with each other when the printhead is in the printing position.

20. A printer according to claim 15; wherein the pressing body comprises a biasing member.

21. A printer according to claim 20; wherein the biasing member comprises a torsion spring having a horizontal portion centrally thereof for pressing the rear surface portion of the printhead in point contact therewith.

22. A printer according to claim 20; wherein the biasing member comprises a shaft rotatably supported by the frame, a plane portion integrally connected to the shaft centrally thereof, and a torsion spring for pressing the plane portion into point contact with the rear surface portion of the printhead.

23. A printer according to claim 20; wherein the biasing member comprises a first shaft rotatably supported by the frame, a second shaft integrally connected to the first shaft centrally thereof, and a torsion spring for pressing the second shaft into point contact with the rear surface portion of printhead.

24. A printer according to claim 23; wherein each of the rear surface portion of the printhead and the second shaft of the biasing member has a convex cylindrical surface in point contact with each other when the printhead is in the printing position.

25. A printer according to claim 14; wherein each of the side walls has first portions having a first preselected thickness and second portions having a second preselected thickness greater than the first preselected thickness; and wherein the printhead has an upper portion supported by the first portions of the side walls and a lower portion integral with the upper portion and supported by the second portions of the side walls, the upper portion having a first preselected width, the lower portion having a second preselected width smaller than the first preselected width.

26. A printer comprising: a frame having a pair of side walls spaced apart a given distance according to a given width size of a recording medium; a platen supported between the pair of side walls and having a surface for supporting the recording medium; a printhead supported between the side walls and operable in a printing position thereof to perform a printing operation on the recording medium; the printhead extending substantially from one side wall to the other side wall means supporting the printhead to the side walls of the frame for movement of the printhead in forward/backward and rightward/leftward directions relative to the frame; and a pressing body supported by the frame for pressing the printhead into contact with the surface of the platen; whereby the printhead can in forward/backward and rightward/leftward directions relative to the frame to permit angular adjustment thereof, following the surface of the platen, when the printhead is in the printing position.

27. A printer according to claim 26; wherein the pressing body presses the printhead in point contact therewith when the printhead is in the printing position.

28. A printer according to claim 26; wherein the printhead comprises a support body; and wherein the means supporting the printhead comprises a pair of pins extending from the support body each for engagement with one of the side walls of the frame.

29. A printer according to claim 26; wherein the printhead comprises a support body having a first portion and a second portion integral with the first portion; and wherein the means supporting the printhead comprises a first pair of pins extending from the first portion each for engagement with one of the side walls of the frame, and a second pair of pins extending from the second portion each for engagement with one of the side walls of the frame.

* * * * *